United States Patent [19]

Nongbri et al.

[11] 4,427,535

[45] Jan. 24, 1984

[54] SELECTIVE OPERATING CONDITIONS FOR HIGH CONVERSION OF SPECIAL PETROLEUM FEEDSTOCKS

[75] Inventors: Govanon Nongbri, Newtown; Susan M. Brandt, Oakford, both of Pa.; Michael C. Chervenak, Pennington, N.J.

[73] Assignee: Hydrocarbon Research, Inc., Lawrenceville, N.J.

[21] Appl. No.: 317,214

[22] Filed: Nov. 2, 1981

[51] Int. Cl.[3] ..... C10G 47/10; C10G 47/26

[52] U.S. Cl. ..... 208/112

[58] Field of Search ..... 208/112, 48 R

[56] References Cited

U.S. PATENT DOCUMENTS

| | | | |
|---|---|---|---|
| 3,725,247 | 4/1973 | Johnson et al. | 208/48 R |
| 3,841,981 | 10/1974 | Layng | 208/112 |
| 3,844,933 | 10/1974 | Wolk et al. | 208/59 |
| 3,887,455 | 6/1975 | Hamner et al. | 208/112 |
| 3,948,756 | 4/1976 | Wolk et al. | 208/57 |

*Primary Examiner*—Delbert E. Gantz
*Assistant Examiner*—G. E. Schmitkons
*Attorney, Agent, or Firm*—V. A. Mallare; F. A. Wilson

[57] ABSTRACT

A process for the catalytic hydroconversion of special petroleum feedstocks, containing 10–28 W % asphaltenes, and having Ramsbottom carbon residue of 12–35 W %, such as Cold Lake and Lloydminster crude and residua materials. In the process, high percentage conversion (65–80 V %) to lower boiling hydrocarbon products can be achieved by maintaining a narrow range of reaction conditions, preferably in an ebullated bed catalytic reactor. Reaction temperature is 780°–835° F., hydrogen partial pressure is 2000–3000 psig, and space velocity is 0.25–5.0 $V_f/hr/V_r$. Higher conversion of about 80 to 95 volume percent can be obtained with recycle of 975° F.+ vacuum bottoms fraction to the reactor. Useful catalysts have total pore volume of about 0.5–0.9 cc/gm and include cobalt-molybdenum and nickel-molybdenum on alumina support.

13 Claims, 5 Drawing Figures

SELECTIVE OPERATING CONDITIONS FOR HIGH CONVERSION OF SPECIAL PETROLEUM FEEDSTOCKS

BACKGROUND OF INVENTION

This invention pertains to the catalytic hydroconversion of special heavy petroleum feedstocks which contain asphaltenes and have Ramsbottom carbon residues (RCR) exceeding about 10 W %, to produce lower boiling hydrocarbon liquid products, and pertains particularly to such process using selective reaction conditions including temperature below about 835° F.

High catalytic hydroconversion operations on heavy petroleum feedstocks, such as achieving more than about 75 V % conversion to produce lower boiling hydrocarbon liquids and gases, are usually carried out in a reaction temperature range of 830° to 860° F. and within a relatively high space velocity range of about 0.8 to 1.2 $V_f/Hr/V_r$, in order to minimize reactor volume and associated costs. This type of conversion operation has been found useful for many heavy petroleum feedstocks to produce lower-boiling liquids and gases. However, some special heavy petroleum feedstocks exist which have high carbon, as indicated by Ramsbottom carbon residues of 15–35 W %, such as Cold Lake and Lloydminster crudes from Canada and Orinoco tar from Venezuela, which have special characteristics and for which these normal hydroconversion reaction conditions cannot be used, because it has been found that coking of the catalyst bed occurs which makes the process inoperable. The reason for such severe coking is due to the precipitation of asphaltenes because of the imbalance in concentration between asphaltenes and solvent. It has been observed that although other petroleum feedstocks may contain similar amounts of Ramsbottom carbon residue (RCR) in range of 14–26 W %, they do not present the same operating difficulties as the Cold Lake type materials, which have RCR of only about 23 W %.

Prior art hydroconversion processes for petroleum feeds have not provided a satisfactory solution to this problem of processing such special heavy feedstocks, in that it has not disclosed specific ranges of operating conditions suitable for successful hydroconversion operations without resorting to using a diluent oil mixed with the feed. For example, U.S. Pat. No. 3,725,247 to Johnson et al discloses a catalytic process for hydroconversion of heavy oil feedstocks containing substantial asphaltenes at operating conditions within the range of 750°–850° F. temperature and 1000–3000 psig hydrogen pressure, by using a diluent oil and limiting the percentage conversion achieved based on not exceeding a critical heptane insoluble number range. But it does not disclose a combination of moderate reaction temperatures and low space velocity conditions needed for successful hydroconversion operations on such feeds. Also, U.S. Pat. No. 3,948,756 to Wolk et al. discloses a process for desulfurizing residual oils containing high asphaltenes by catalytically converting the asphaltenes and then desulfurizing the treated material. This approach uses relatively mild reaction conditions of 720°–780° F. temperature, 1500–2400 psig hydrogen partial pressure, and liquid space velocity of 0.3–1.0 $V_f/Hr/V_r$ to convert the asphaltenes and provide a product having reduced RCR fo subsequent coking operations, so as to make less coke and more liquid product. However, such reaction conditions were found to be unsatisfactory for hydroconversion processing of certain heavy petroleum feedstocks, such as the Cold Lake and Lloydminster materials.

To carry out successful hydroconversion operations with these special kinds of petroleum feedstocks, a special range of reactor operating conditions has been developed which preferentially hydrocracks the asphaltenes with respect to nonasphaltene resids. These conditions substantially prevent coking of the catalyst bed and provide long term continuous operations without using a diluent oil blended with the feed.

SUMMARY OF THE INVENTION

This invention discloses a process for the catalytic hydroconversion of special heavy petroleum feedstocks containing at least about 8 W % and usually 10–28 W % asphaltenes, and having Ramsbottom carbon residue (RCR) at least about 10 W %, and usually 12–30 W %, to produce lower boiling hydrocarbon liquids and gases. The process uses a selective range of catalytic reaction conditions that have been found necessary to achieve successful hydroconversion operations on such heavy feedstocks having these asphaltene and RCR characteristics. The reaction conditions must be selected so as to maintain the percentage hydroconversion of the non-RCR resid material boiling above 975° F. in the feed greater than the conversion of the 975° F.+ RCR resid material. Preservation of the non-RCR resid material provides the solvent needed for the RCR material to be maintained in solution and avoid undesired coking.

More specifically, we have determined that successful catalytic hydroconversion operations for such special feedstocks require reaction temperatures maintained below about 835° F., and also require using low space velocities less than about 0.5 $V_f/hr/V_r$ (volume feed per hour per volume of reactor) to achieve significant conversion of these feedstocks, such as Cold Lake and Lloydminster crude and residua. Thus, the present invention provides a high hydroconversion operation at relatively severe reaction conditions, and thereby achieves high percentage conversion of the fractions normally boiling above about 975° F. to lower-boiling liquids by preferentially destroying the asphaltenes.

The broad reaction conditions required for hydroconverting these special petroleum feedstocks are reactor temperature within the ranges of 760°–835° F., hydrogen partial pressure of 2000–3000 psig, and liquid hourly space velocity (LHSV) of 0.25 to 0.5 Vf/Hr/Vr. Preferred reaction conditions are 790°–830° F. temperature and 2200–2800 psig hydrogen partial pressure. These conditions provide for at least about 75 V % hydroconversion of the Ramsbottom carbon residue (RCR) and non-RCR materials boiling above 975° F. in the feed to lower boiling materials.

The catalyst used should have a suitable range of total pore volume and pore size distribution, and can consist of cobalt-molybdenum or nickel-molybdenum on alumina support. The catalyst should have total pore volume at least about 0.5 cc/gm and is preferably 0.6–0.9 cc/gm. The desired catalyst pore size distribution is as follows:

TABLE 1

| Pore Diameter, Angstroms | Pore Volume, % of Total |
|---|---|
| >30 | 100 |
| >250 | 32–35 |

TABLE 1-continued

| Pore Diameter, Angstroms | Pore Volume, % of Total |
|---|---|
| >500 | 15–28 |
| >1500 | 4–23 |
| >4000 | 4–14 |

The level or percentage of feedstock conversion to lower-boiling liquids and gases achieved using this process is about 65–75 V % for straight-through type operations, i.e. without recycle of a heavy liquid fraction to the reactor for further conversion therein. When recycle of the vacuum bottoms fraction usually boiling above about 975° F. to the reaction zone is used, the conversion is usually 80–95 V %. Although it is considered that any type catalytic reaction zone can be used under proper conditions for hydroconversion of these feedstocks, operations are preferably carried out in an upward flow, ebullated catalyst bed type reactor, as generally described by U.S. Pat. No. Re. 25,770 to Johanson. If desired, the reaction zone may consist of two reactors connected in series, with each reactor being operated at substantially the same temperature and pressure conditions.

DESCRIPTION OF PREFERRED EMBODIMENT

Figure 1:
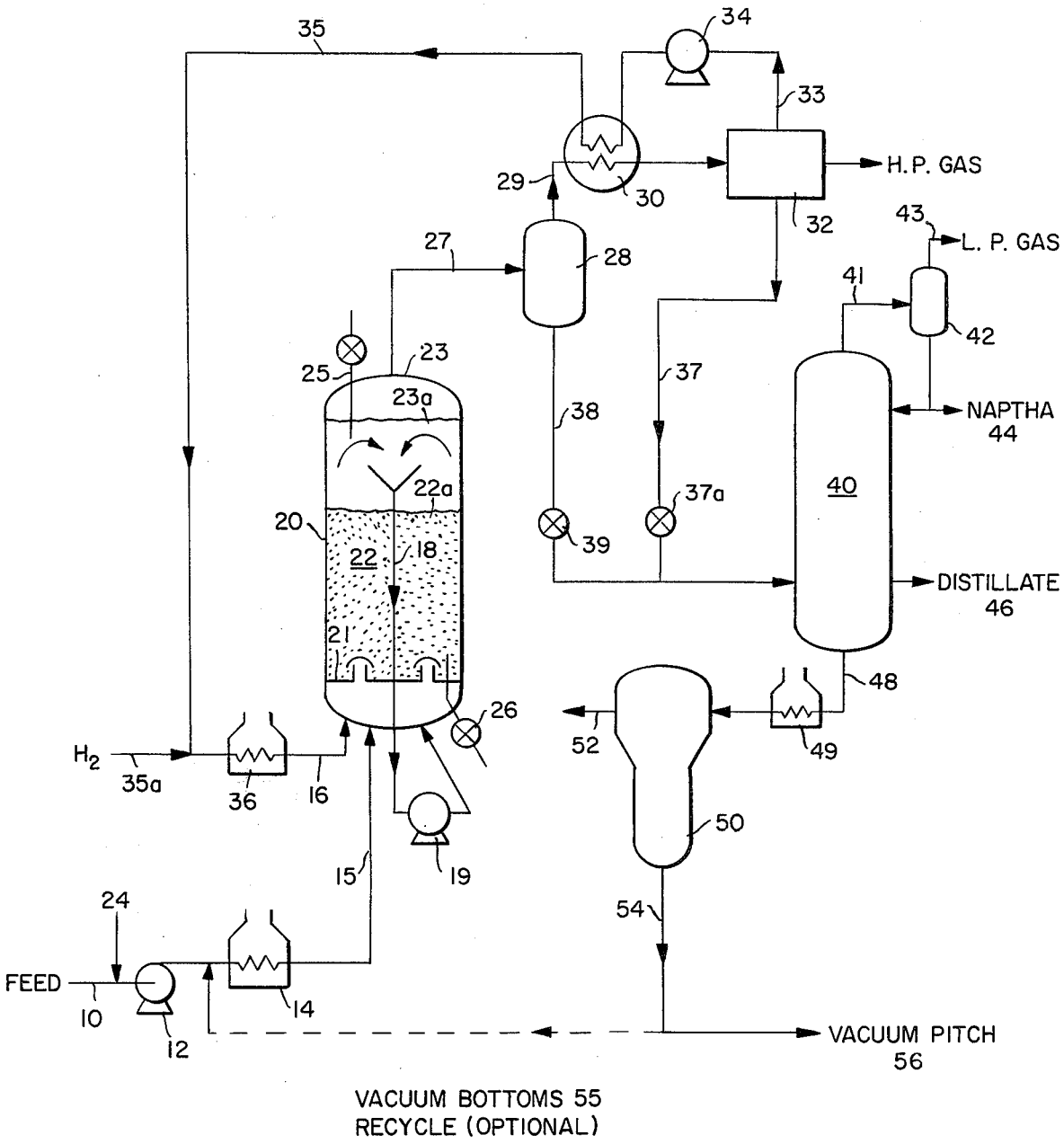
FIG. 1 shows a hydroconversion process for petroleum feedstocks using an ebullated bed catalytic reactor according to the invention.

As illustrated by FIG. 1, a heavy petroleum feedstock at 10, such as Cold Lake or Lloydminster bottoms from Canada or Orinoco crude from Venezuela, is pressurized at 12 and passed through preheater 14 for heating to at least about 500° F. The heated feedstream at 15 is introduced into upflow ebullated bed catalytic reactor 20. Heated hydrogen is provided at 16, and is also introduced into reactor 20. This reactor is typical of that described in U.S. Pat. No. Re. 25,770, wherein a liquid phase reaction is accomplished in the presence of a reactant gas and a particulate catalyst such that the catalyst bed 22 is expanded. The reactor has a flow distributor and catalyst support 21, so that the feed liquid and gas passing upwardly through the reactor 20 will expand the catalyst bed by at least about 10% over its settled height, and place the catalyst in random motion in the liquid.

The catalyst particles in bed 22 usually have a relatively narrow size range for uniform bed expansion under controlled liquid and gas flow conditions. While the useful catalyst size range is between 6 and 100 mesh (U.S. Sieve Series) with an upflow liquid velocity between about 1.5 and 15 cubic feet per minute per square foot of reactor cross section area, the catalyst size is preferably particles of 6 and 60 mesh size including extrudates of approximately 0.010–0.130 inch diameter. We also contemplate using a once-through type operation using fine sized catalyst in the 80–270 mesh size range (0.002–0.007 inch) with a liquid velocity in the order of 0.2–15 cubic feet per minute per square foot of reactor cross-section area. In the reactor, the density of the catalyst particles, the liquid upward flow rate, and the lifting effect of the upflowing hydrogen gas are important factors in the expansion of the catalyst bed. By control of the catalyst particle size and density and the liquid and gas velocities and taking into account the viscosity of the liquid at the operating conditions, the catalyst bed 22 is expanded to have an upper level or interface in the liquid as indicated at **22*a***. The catalyst bed expansion should be at least about 10% and seldom more than 150% of the bed settled or static level.

The hydroconversion reaction in bed 22 is greatly facilitated by use of a proper catalyst. The catalyst used is a typical hydrogenation catalyst containing activation metals selected from the group consisting of cobalt, molybdenum, nickel and tungsten and mixtures thereof, deposited on a support material selected from the group of silica, alumina and combinations thereof. If a fine-size catalyst is used, it can be effectively introduced to the reactor at connection 24 by being added to the feed in the desired concentration, as in a slurry. Catalyst may also be periodically added directly into the reactor 20 through suitable inlet connection means 25 at a rate between about 0.1 and 0.2 lbs catalyst/barrel feed, and used catalyst is withdrawn through suitable draw-off means 26.

Recycle of reactor liquid from above the solids interface **22*a* to below the flow distributor 21 is usually desirable to establish a sufficient upflow liquid velocity to maintain the catalyst in random motion in the liquid and to facilitate completeness of the reaction. Such liquid recycle is preferably accomplished by the use of a central downcomer conduit 18 which extends to a recycle pump 19 located below the flow distributor 21, to assure a positive and controlled upward movement of the liquid through the catalyst bed 22. The recycle of liquid through internal conduit 18** has some mechanical advantages and tends to reduce the external high pressure connections needed in a hydrogenation reactor, however, liquid recycle upwardly through the reactor can be established by an external recycle pump.

Operability of the ebullated catalyst bed reactor system to assure good contact and uniform (iso-thermal) temperature therein depends not only on the random motion of the relatively small catalyst in the liquid environment resulting from the buoyant effect of the upflowing liquid and gas, but also requires the proper reaction conditions. With improper reaction conditions insufficient hydroconversion is achieved, which results in a non-uniform distribution of liquid flow and operational upsets, usually resulting in excessive coke deposits on the catalyst. Different feedstocks are found to have more or less asphaltene precursors which tend to aggravate the operability of the reactor system including the pumps and recycle piping due to the plating out of tarry deposits. While these can usually be washed off by lighter diluent materials, the catalyst in the reactor unit may become completely coked up and require premature shut down of the process.

For the special petroleum feedstocks of this invention, i.e. those having asphaltenese at least about 8 W % and having Ramsbottom carbon residue (RCR) at least about 10 W %, the operating conditions needed in the reactor 20 are within the ranges of 760°–835° F. temperature, 2000–3000 psig, hydrogen partial pressure, and space velocity of 0.20–0.50 $V_f$/hr/$V_r$ (volume feed per hour per volume of reactor). Preferred conditions are 790°–830° F. temperature, 2200–2800 psig, hydrogen partial pressure, and space velocity of 0.25–0.40 $V_f/hr/V_r$. The feedstock hydroconversion achieved is at least about 75 V % for once-through type operations.

In a reactor system of this type, a vapor space 23 exists above the liquid level 23a and an overhead stream containing both liquid and gas portions is withdrawn at 27, and passed to hot phase separator 28. The resulting gaseous portion 29 is principally hydrogen, which is cooled at heat exchanger 30, and may be recovered in gas purification step 32. The recovered hydrogen at 33 is warmed at heat exchanger 30 and recycled by compressor 34 through conduit 35, reheated at heater 36, and is passed into the bottom of reactor 20 along with make-up hydrogen at 35a as needed.

From phase separator 28, liquid portion stream 38 is withdrawn, pressure-reduced at 39 to pressure below about 200 psig, and passed to fractionation step 40. A condensed vapor stream also is withdrawn at 37 from gas purification step 32 and also passed to fractionation step 40, from which is withdrawn a low pressure gas stream 41. This vapor stream is phase separated at 42 to provide low pressure gas 43 and liquid stream 44 to provide reflux liquid to fractionator 40 and naphtha product stream 44. A middle boiling range distillate liquid product stream is withdrawn at 46, and a heavy hydrocarbon liquid stream is withdrawn at 48.

From fractionator 40, the heavy oil stream 48 which usually has normal boiling temperature range of 700°–975° F., is withdrawn, reheated in heater 49 and passed to vacuum distillation step 50. A vacuum gas oil stream is withdrawn at 52, and vacuum bottoms stream is withdrawn at 54. If desired, a portion 55 of the vacuum bottoms material usually boiling above about 975° F. can be recycled to heater 14 and reactor 20 for further hydroconversion, such as to achieve 85–90 V % conversion to lower boiling materials. The volume ratio of the recycled 975° F.+ material to the feed should be within the range of about 0.2–1.5. A heavy vacuum pitch material is withdrawn at 56.

This invention will be better understood by reference to the following examples of actual hydroconversion operations, and which should not be regarded as limiting the scope of the invention.

EXAMPLE 1

Catalytic hydroconversion operations were conducted on Cold Lake oils in a fixed-bed reactor at 780°–840° F. temperature and 2000–2700 psig hydrogen partial pressure. The feedstock characteristics are given in Table 2. The catalyst used was cobalt-molybdenum on alumina in form of 0.030–0.035 inch diameter extrudates, having pore size distribution as previous shown in Table 1.

TABLE 2

FEEDSTOCK INSPECTIONS

| Feedstock | Cold Lake Crude | Cold Lake Vacuum Bottoms |
|---|---|---|
| Volume of Crude, % | 100 | 67.5 |
| Gravity, °API | 11.1 | 4.9 |
| Sulfur, W % | 4.71 | 5.74 |
| Carbon, W % | 83.5 | 83.2 |
| Hydrogen, W % | 10.7 | 10.0 |
| Oxygen, W % | 1.36 | 0.75 |
| Nitrogen, ppm | 3900 | 5150 |
| Vanadium, ppm | 170 | 263 |
| Nickel, ppm | 63 | 95 |
| Distillation | | |
| IBP–975° F., V % | — | 19.0 |
| IBP–400° F., V % | 1.0 | — |
| 400–650° F., V % | 13.0 | — |
| 650–975° F., V % | 31.1 | — |
| 975° F.+, V % | 54.7 | 81.0 |
| 975° F.+ Properties | | |
| Gravity, °API | — | 2.1 |
| Sulfur, W % | 6.15 | 6.08 |
| RCR, W % | 23.6 | 23.1 |
| Non-RCR, W % | 76.4 | 76.9 |

Results of Runs 1 and 2 presented in Table 3 below illustrate the successful operations conducted on these special type petroleum feedstocks using reaction conditions as taught by this invention. After 13 to 18 days operation, inspection of the catalyst bed showed the catalyst was in a free-flowing condition, indicating successful operations. The reaction conditions and results are presented in Table 3 below:

TABLE 3

| | Run No. | | | | |
|---|---|---|---|---|---|
| | 1 | 2 | 3 | 4 | 5 |
| Feed | ←Cold Lake Crude→ | | | | |
| Reactor Temperature, °F. | 780–810 | 790–811 | 809–830 | 832–836 | 834–840 |
| $H_2$ Pressure, psig | 2700 | 2700 | 2700 | 2000 | 2000 |
| Liquid Space Velocity, V/Hr/$V_r$ | 0.3 | 0.3–0.5 | 0.8–1.0 | 0.9–1.0 | 0.85–0.95 |
| 975° F.+ Conversion, V % | 62–86 | 77–85 | 67–69 | 70–76 | 64–84 |
| Days on Stream | 13 | 18 | 4 | 5 | 7 |
| % Carbon on Catalyst, W % | 20.7 | 18.0 | 25.6 | 33.1 | 34.6 |
| Condition of Catalyst Bed | Free Flowing | | Agglomerated into a hard solid plug | | |
| Operations | Successful | | Unsuccessful | | |

In contrast, results of Runs 3, 4 and 5 in Table 3 illustrate unsuccessful operations on the same feedstock due to the reaction conditions being outside the range taught by this invention. In these operations, after only three to seven (3 to 7) days on stream, the catalyst agglomerated into a hard solid plug in the reactor, thus making further operations impossible.

Figure 2:
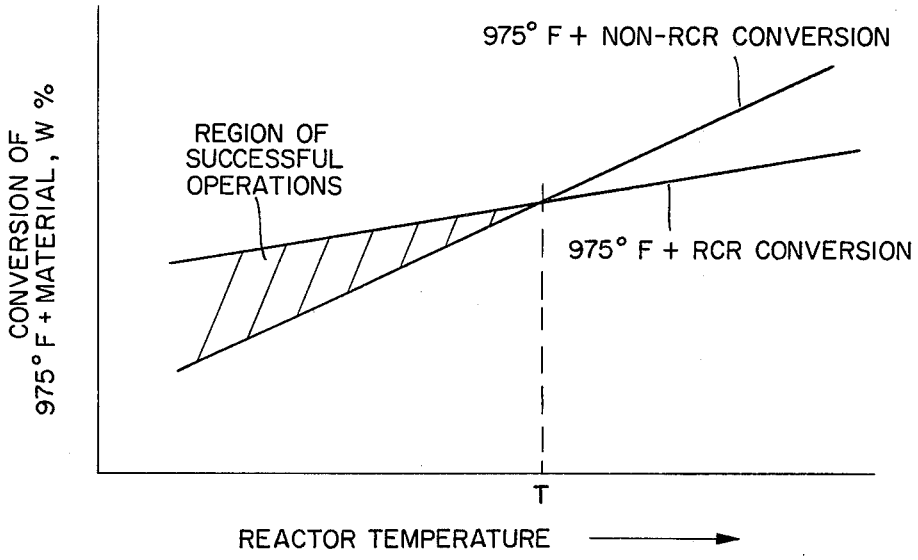
FIGS. 2 and 3 are graphs showing generally how the hydroconversion of the RCR and non-RCR materials in the feed are affected by the reaction temperature and pressure, respectively.

FIG. 2 generally shows the variation of percent conversion of the RCR and non-RCR materials with reaction temperature. It is noted that as the temperature increases, both conversions increase; however, the rate of conversion increase for the non-RCR material normally boiling above 975° F. is higher than for the RCR material having same boiling range. Because the unconverted non-RCR material provides solvent to maintain the RCR material in solution in the reactor during the hydroconversion reactions, precipitation of the RCR material will not occur below the temperature "T" at which the percentage conversion of these materials become substantially equal. Thus, successful hydroconversion operations occur at reaction temperatures below "T".

Figure 3:
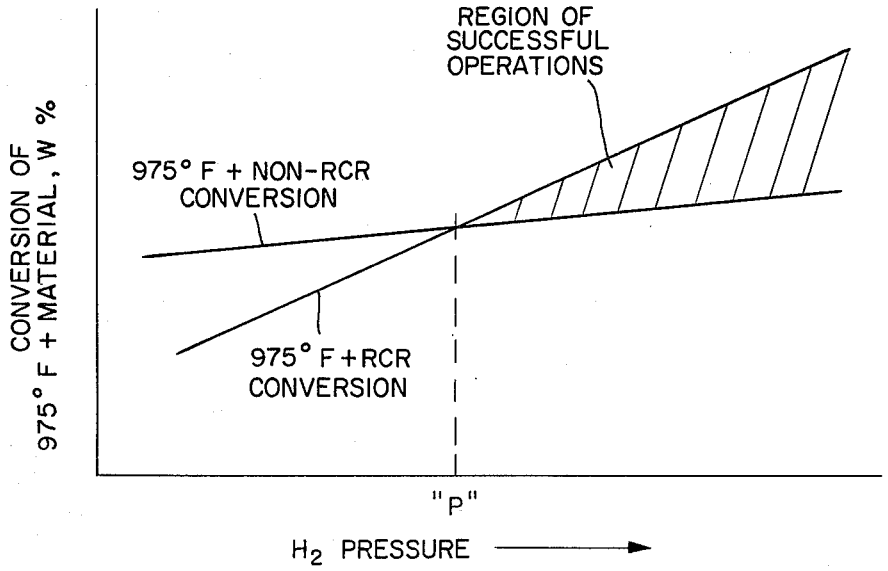

Similarly, FIG. 3 shows the variation of percent conversion with reaction partial pressure of hydrogen. It is noted that the percent conversion of RCR material boiling above 975° F. exceeds that of the 975° F.+ non-RCR material at pressure greater than "P" and that successful hydroconversion operations are achieved above this pressure. Thus, a combination of reaction temperature and pressure conditions must be selected which prevent precipitation of asphaltenes in the reactor, and thereby provides for successful extended hydroconversion operations on these special feedstocks.

Figure 4:
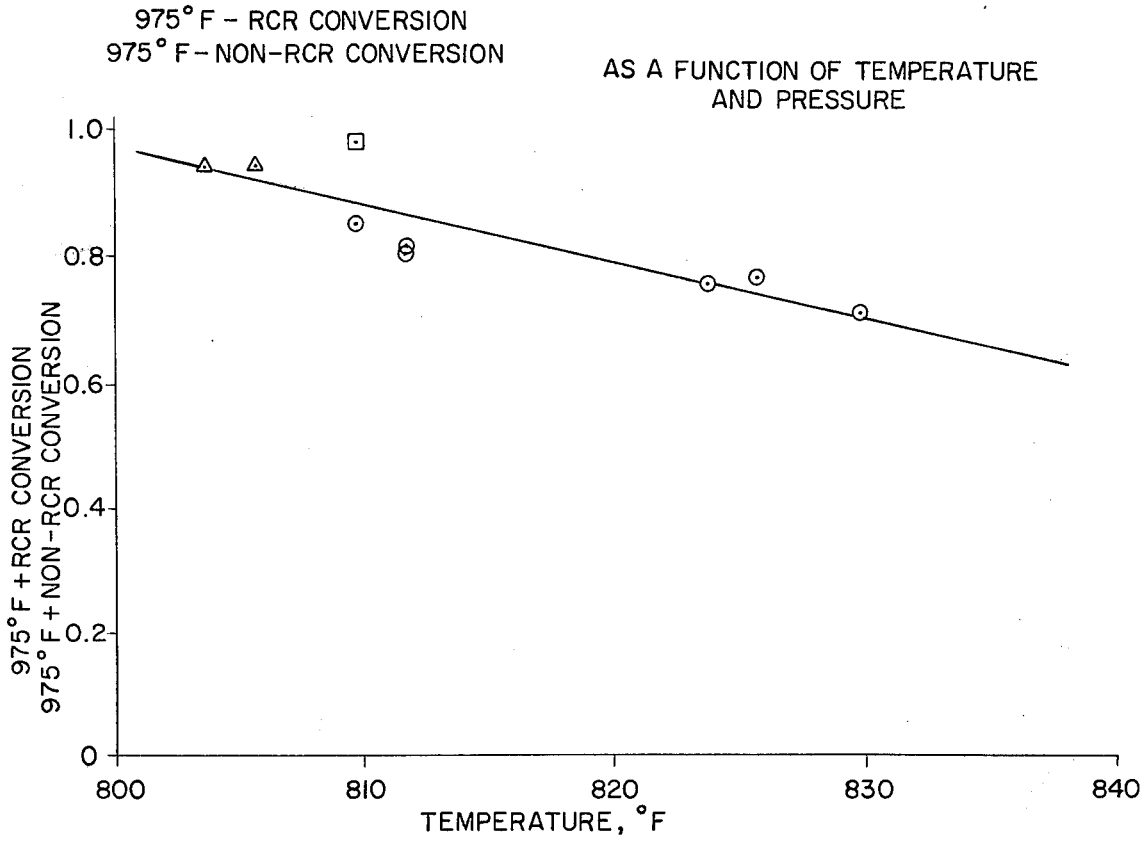
FIGS. 4 and 5 are graphs showing the ratio of conversions of the RCR and non-RCR materials plotted against reaction temperature and pressure, respectively.
Figure 5:
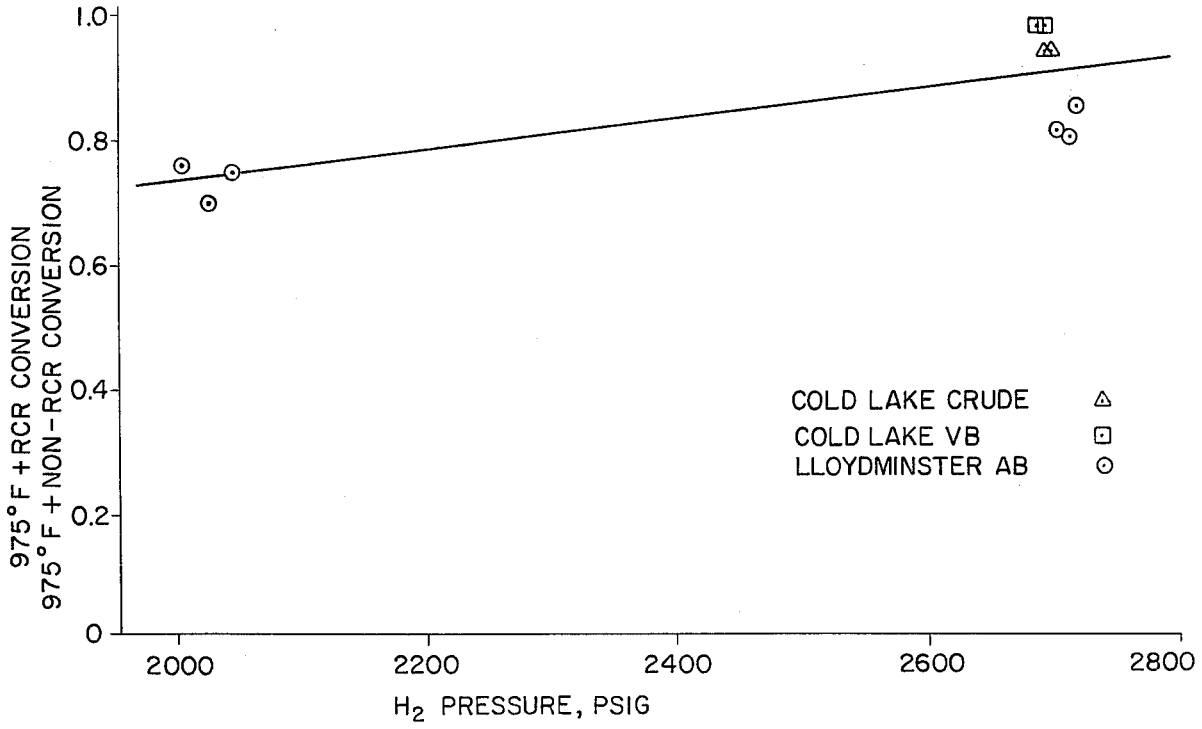

The results of these runs, as well as those also obtained on Lloydminster atmospheric bottoms material, are presented in FIGS. 4 and 5. FIG. 4 shows the ratio of percent conversion of 975° F.+ RCR material to 975° F.+ non-RCR materials plotted against reactor temperature. This ratio of conversions is plotted against reactor hydrogen partial pressure in FIG. 5. As shown, the ratio of RCR material boiling above 975° F. to non-RCR material boiling above 975° F. should be maintained within the range of 0.65 to 1.1, and preferably should be maintained within the range of 0.65 to 1.1, and preferably should be within the range of 0.7–1.0. It is noted that to attain these useful ratios of conversion of the Ramsbottom carbon residue (RCR) materials to non-RCR materials of 0.65–1.1, the reactor temperature must be maintained below about 835° F. and preferably within the range of 790°–830° F. In order to maintain conversion of the 975° F.+ material above 75%, liquid space velocity is generally maintained below about 0.5 $V_f/hr/V_r$. Furthermore, to achieve such useful ratios of conversions, the reactor hydrogen partial pressure must be maintained above about 2000 psig and preferably within the range of 2200–2800 psig.

EXAMPLE 2

Catalytic operations were also conducted successfully on Lloydminster atmospheric bottoms material using atmospheric bottoms recycle operations. Feedstock inspections are provided in Table 4. The reaction conditions used and the results achieved at shown in Table 5.

TABLE 4

| INSPECTION ON LLOYDMINSTER ATMOSPHERIC BOTTOMS | |
|---|---|
| Gravity, °API | 8.9 |
| Elemental Analyses | |
| Sulfur, W % | 4.60 |
| Carbon, W % | 83.7 |
| Hydrogen, W % | 10.7 |
| Oxygen, W % | 0.9 |
| Nitrogen, W % | 0.36 |
| Vanadium, ppm | 144 |
| Nickel, ppm | 76 |
| Iron, ppm | 31 |
| Chlorides, ppm | 8 |
| Pentane Insolubles, W % | 16.0 |
| RCR, W % | 10.9 |
| Viscosity, SFS @ 210° F. | 253 |
| Distillation | |
| IBP, °F. | 487 |
| IBP–650° F., V % | 4.0 |
| 650–975° F., V % | 38.0 |
| 975° F.+, V % | 58.0 |
| 975° F.+ Properties | |
| Gravity, °API | 4.2 |

TABLE 4-continued

| INSPECTION ON LLOYDMINSTER ATMOSPHERIC BOTTOMS | |
|---|---|
| Sulfur, W % | 5.56 |
| Ash, W % | 0.10 |
| Vanadium, ppm | 219 |
| Nickel, ppm | 123 |
| Iron, ppm | 49 |
| RCR, W % | 23.0 |
| Non-RCR, W % | 77.0 |

TABLE 5

| PROCESSING OF LLOYDMINSTER VACUUM BOTTOMS | | |
|---|---|---|
| Operating Conditions | | Recycle Operations on Atm. Bottoms |
| Reactor Temperature, °F. | 816 | 812 |
| Hydrogen Pressure, psig | 2695 | 2720 |
| Liquid Space Velocity, $V/Hr/V_r$ | 0.42 | 0.30 |
| Chemical Hydrogen Consumption, SCF/Bbl | 1305 | 1095 |
| Recycle Ratio, Vol. 975° F.+/$V_{feed}$ | 0.50 | 0.55 |
| Product Yields, W % | | |
| $H_2S$, $NH_3$, $H_2O$ | 4.5 | 4.4 |
| $C_1$–$C_3$ Gas | 3.5 | 4.2 |
| $C_4$–400° F. | 18.6 | 16.4 |
| 400–650° F. | 27.0 | 21.8 |
| 650–975° F. | 46.4 | 46.3 |
| 975° F.+ | 1.9 | 8.5 |
| Total | 101.9 | 101.6 |
| $C_4$ + Liquid | 93.9 | 93.0 |
| 975° F.+ Conversion, V % | 97.1 | 86.4 |

It is noted that successful conversion of this feed to materials boiling below 975° F. was achieved, with conversion ranging from about 65% for single pass operations to 86–97 V % for atmospheric bottoms recycle operations. The catalyst used was the same commercial cobalt-molybdenum on alumina support material used for Example 1.

Although we have disclosed certain preferred embodiments of our invention, it is recognized that various modifications can be made thereto, all within the spirit and scope of the invention, which is defined by the following claims.

We claim:

1. A process for catalytic hydroconversion of petroleum feedstocks containing at least about 8 W % asphaltenes and having at least about 10 W % Ramsbottom carbon residue (RCR) to produce lower boiling distillate liquids, which comprises:

(a) introducing the feedstock with hydrogen into a reaction zone containing a particulate hydrogenation catalyst;

(b) maintaining said reaction zone at a temperature between about 760° F. to 835° F., hydrogen partial pressure between about 2000 to 3000 psig, and liquid hourly space velocity between about 0.25 to 0.50 $V_f/hr/V_r$ and hydroconverting at least about 65 V % of the feedstock to lower boiling hydrocarbon materials; and (c) withdrawing the hydroconverted material and fractionating it to produce hydrocarbon gas and liquid products.

2. The process of claim 1, wherein the catalyst has particle size within the range of about 0.01 to 0.130 inch diameter and total pore volume exceeding about 0.5 cc/gm.

3. The process of claim 1, wherein the reaction zone is an upflow ebullated catalyst bed type and the catalyst size is within the range of about 0.01 to 0.04 inch diameter.

4. The process of claim 1, wherein a heavy hydrocarbon liquid fraction normally boiling above about 975° F. is withdrawn from the fractionation step and recycled to the reaction zone wherein about 75–90 V % of the feedstock is hydroconverted to lower boiling hydrocarbon products.

5. The process of claim 4, wherein the recycle ratio of recycled oil volume to feedstock volume is within the range of about 0.2 to about 1.5.

6. The process of claim 1, wherein the feedstock is Cold Lake crude oil and the percent hydroconversion achieved in single pass operations is about 70–80 V % to lower boiling hydrocarbon products.

7. The process of claim 1, wherein the ratio of conversion for Ramsbottom carbon residue to non-Ramsbottom carbon residue boiling above 975° F. is within the range of about 0.65 to 1.1.

8. The process of claim 1, wherein the feedstock is Cold Lake residuum, and a heavy fraction boiling above 975° F. is recycled to the reaction zone for increasing conversion to about 85–95%.

9. The process of claim 1, wherein the feedstock is Lloydminster atmospheric bottoms material, and the percent conversion achieved is about 70–80 V % to lower boiling hydrocarbon products.

10. The process of claim 1, wherein the feedstock is Lloydminster atmospheric bottoms material and a heavy fraction boiling above 975° F. is recycled to the reaction zone for increasing conversion to 85–95 V %.

11. The process of claim 1, wherein the reaction conditions are within the ranges of 790°–830° F. temperature, 2200–2800 psig hydrogen partial pressure, and 0.25–0.40 $V_f/hr/V_r$ liquid hourly space velocity.

12. A process for catalytic hydroconversion of heavy petroleum feedstocks containing at least 10 W % asphaltenes and having at least about 10 W % Ramsbottom carbon residue (RCR) to produce lower boiling distillable liquids, which comprises the steps:

(a) introducing the feedstock with hydrogen into an ebullated bed catalytic reaction zone containing cobalt-molybdenum catalyst having particle size within the range of 0.01 to 0.04 inch diameter and total pore volume exceeding about 0.5 cc/gm.

(b) maintaining said reaction zone at temperature between about 790° F. and 830° F., hydrogen partial pressure between 2000–2800 psig, and liquid hourly space velocity between 0.30 and 0.40 $V_f/hr/V_r$ and hydroconverting at least about 80 V % of the feedstock to distillable liquids;

(c) fractionating the hydroconverted material to produce hydrocarbon gas and liquid fractions; and (d) withdrawing a heavy liquid fraction normally boiling above about 975° F. from the fractionation step and recycling said fraction to the catalytic reaction zone for increasing hydroconversion of the feedstock to 85–90 V % to produce additional distillable liquid products.

13. The process of claim 12, wherein the ratio of conversions for Ramsbottom carbon residue normally boiling above 975° F. to non-Ramsbottom carbon residue material boiling above 975° F. is within the range of about 0.7 to about 1.0.

* * * * *